US006290415B1

(12) United States Patent
Chen

(10) Patent No.: US 6,290,415 B1
(45) Date of Patent: Sep. 18, 2001

(54) TELESCOPIC DEVICE WITH A FIRM POSITIONING EFFECT

(76) Inventor: Chau-Tsung Chen, 4th Fl., No. 263, Minan W. Rd., Hsinhuang Taipei Hsien (TW)

( * ) Notice: Subject to any disclaimer, the term of this patent is extended or adjusted under 35 U.S.C. 154(b) by 11 days.

(21) Appl. No.: 09/586,262

(22) Filed: May 31, 2000

(51) Int. Cl.[7] ..... B43K 24/08
(52) U.S. Cl. ..... 401/109; 401/112; 15/436
(58) Field of Search ..... 401/109–114; 15/436

(56) References Cited

U.S. PATENT DOCUMENTS 2,865,331 * 12/1958 Marcotte ..... 401/111
2,930,355 * 3/1960 Bollerup ..... 401/113
3,458,264 * 7/1969 Ritter ..... 401/111

FOREIGN PATENT DOCUMENTS

1075981 * 2/1960 (DE) ..... 401/109

* cited by examiner

*Primary Examiner*—Charles R. Eloshway

(74) *Attorney, Agent, or Firm*—Pro-Techtor International Services

(57) ABSTRACT

A telescopic device with a firm positioning effect, comprises a hollow upper sleeve having at least one arcuate recess at the inner wall thereof, and having a through hole at the top portion thereof and internal threads at the lower end thereof; a hollow lower sleeve having external threads disposed at the upper end thereof to be threadedly connected to the internal threads of the hollow upper sleeve, and a hole formed on the lower end thereof; a guide mechanism disposed at the internal portion of the hollow upper sleeve and hollow lower sleeve, and including an intermediate body having a ring portion at top end thereof, a thin rod disposed on the ring portion and a thick rod disposed at the lower end of the intermediate body wherein the thin rod extends to protrude the outside of the top portion of the hollow upper sleeve while the lower end of the thick rod may protrude from the hole of the hollow lower sleeve; a spring positioned at the internal portion of the hollow lower sleeve and through which the thick rod is passed; a hollow cylinder providing for the passage of the thin rod; and a push rod disposed at the top portion of the hollow cylinder and having an elongated channel extending from the bottom thereof and through which the thin rod is inserted, whereby the hollow cylinder downwardly moves and slides into the recess portion when the push rod is pressed so that the thick rod extends out of the hollow lower sleeve.

5 Claims, 18 Drawing Sheets

TELESCOPIC DEVICE WITH A FIRM POSITIONING EFFECT

BACKGROUND OF THE INVENTION

The present invention relates to a telescopic device, more particularly, to a telescopic device with a firm positioning effect which can be applied a scratch awl, a drilling bar, a screw, a ball-pen and the like for achieving a better positioning effect as well as ease of retraction.

FIG. 20 shows the structure of a conventional drill bar and FIG. 21 shows a conventional scratch awl. Neither the drill bar nor the scratch awl is equipped with a telescopic design so that the pointed end thereof could easily injure the skin of the user when they are carried on the pocket of their clothes of the user.

FIG. 22 shows the cross-sectional view of a conventional ball-pen. By pressing a button rod (d), a sliding pin (d1) moves along a channel (b) and is positioned at a positioning slot (c) so that the pen point (f) extends from the pen tube (a), and the ball-pen is ready for use (see FIG. 23). FIG. 24 shows the cross-sectional view of another conventional ball-pen. When a button rod (d) is pressed, the position point (c1) of a pin (c2) moves to a position slot (a1) and the pen point (f) of the ball-pen is exposed for use (see FIG. 25). These two types of conventional ball-pens have a common disadvantage that a firm positioning might not be achieved so that the pen point (f) could easily retract back to the inside of ball-pen during use. The structure of a third conventional ball-pen is shown in FIGS. 26 and 27 and is equipped with the design of a ratchet device. During use of the ball-pen, however, a cam body (d1) which abuts against the positioning portion (b2) might move from it so that the pen point (f) draws back inside the pen tube (a). FIGS. 28 and 29 show the cross-sectional view of a fourth conventional ball-pen. By pressing the rod (d), a pin (k) is urged to slidably move into a positioning slot (b3) disposed at the pen tube (a) of the ball-pen while the push rod (k1) pushes the pen point (f) so as to be exposed outside the body of the ball-pen for use. Such a design has the disadvantage that the pin (k) easily deforms and moves away from the positioning slot (b3) so that the pen point (f) retracts into the pen tube (a).

SUMMARY OF THE INVENTION

To overcome the drawbacks of the conventional ball-pens, an object of the present invention is to provide a telescopic device having a firm positioning effect which can achieve better positioning and ease of retraction.

To achieve the object mentioned above, the present invention provides a telescopic device with a firm positioning effect which comprise a hollow upper sleeve having at least one arcuate recess at the inner wall thereof, and having a through hole at the top portion thereof and internal threads at the lower end thereof, a hollow lower sleeve having external threads disposed at the upper end thereof to be threadedly connected to the internal threads of the hollow upper sleeve, and a hole formed on the lower end thereof, a guide mechanism disposed at the internal portion of the hollow upper sleeve and hollow lower sleeve, and including an intermediate body having a ring portion at top end thereof, a thin rod disposed on the ring portion and a thick rod disposed at the lower end of the intermediate body wherein the thin rod extends to protrude the outside of the top portion of the hollow upper sleeve while the lower end of the thick rod may protrude from the hole of the hollow lower sleeve; a spring positioned at the internal portion of the hollow lower sleeve and through which the thick rod is passed; a hollow cylinder providing for the passage of the thin rod; and a push rod disposed at the top portion of the hollow cylinder and having an elongated channel extending from the bottom thereof and through which the thin rod is inserted, whereby the hollow cylinder downwardly moves and slides into the recess portion by when the push rod is pressed so that the thick rod extends out of the hollow lower sleeve.

BRIEF DESCRIPTION OF THE DRAWING

The above objects and advantages of the present invention will become more apparent by the following detailed description of a preferred embodiment thereof in conjunction with the accompanying drawings, in which.

DETAILED DESCRIPTION OF THE PREFERRED EMBODIMENT

Figure 1:
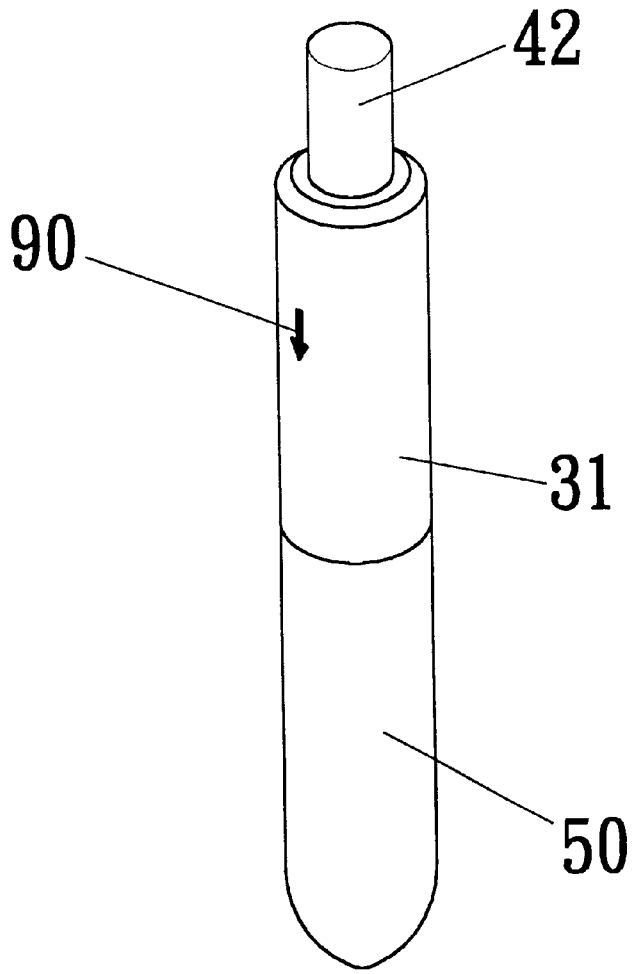
FIG. 1 is a perspective view of the telescopic device according to the present invention.
Figure 2A:
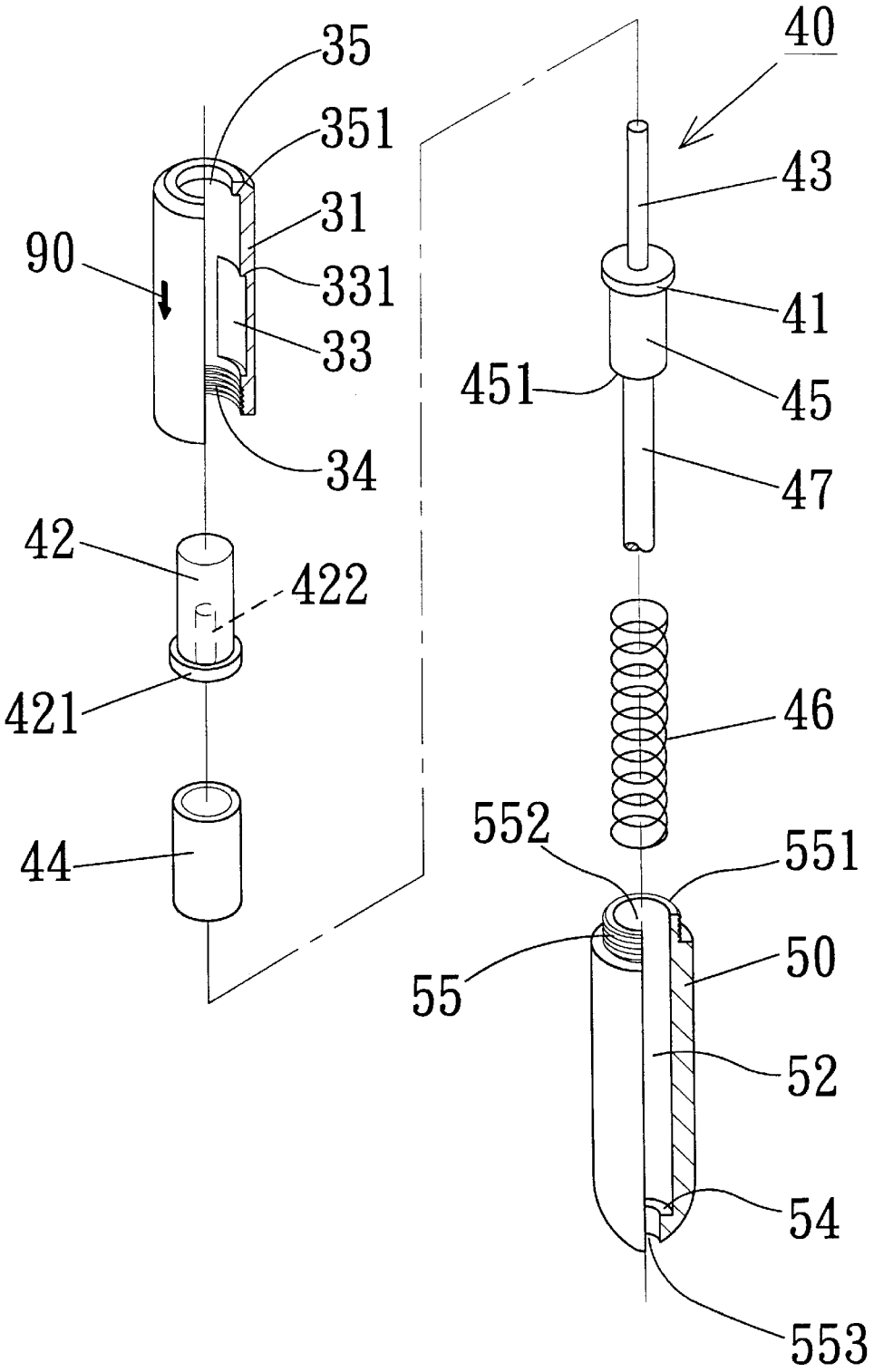
FIG. 2A is an exploded view of the telescopic device according to the present invention.
Figure 2B:
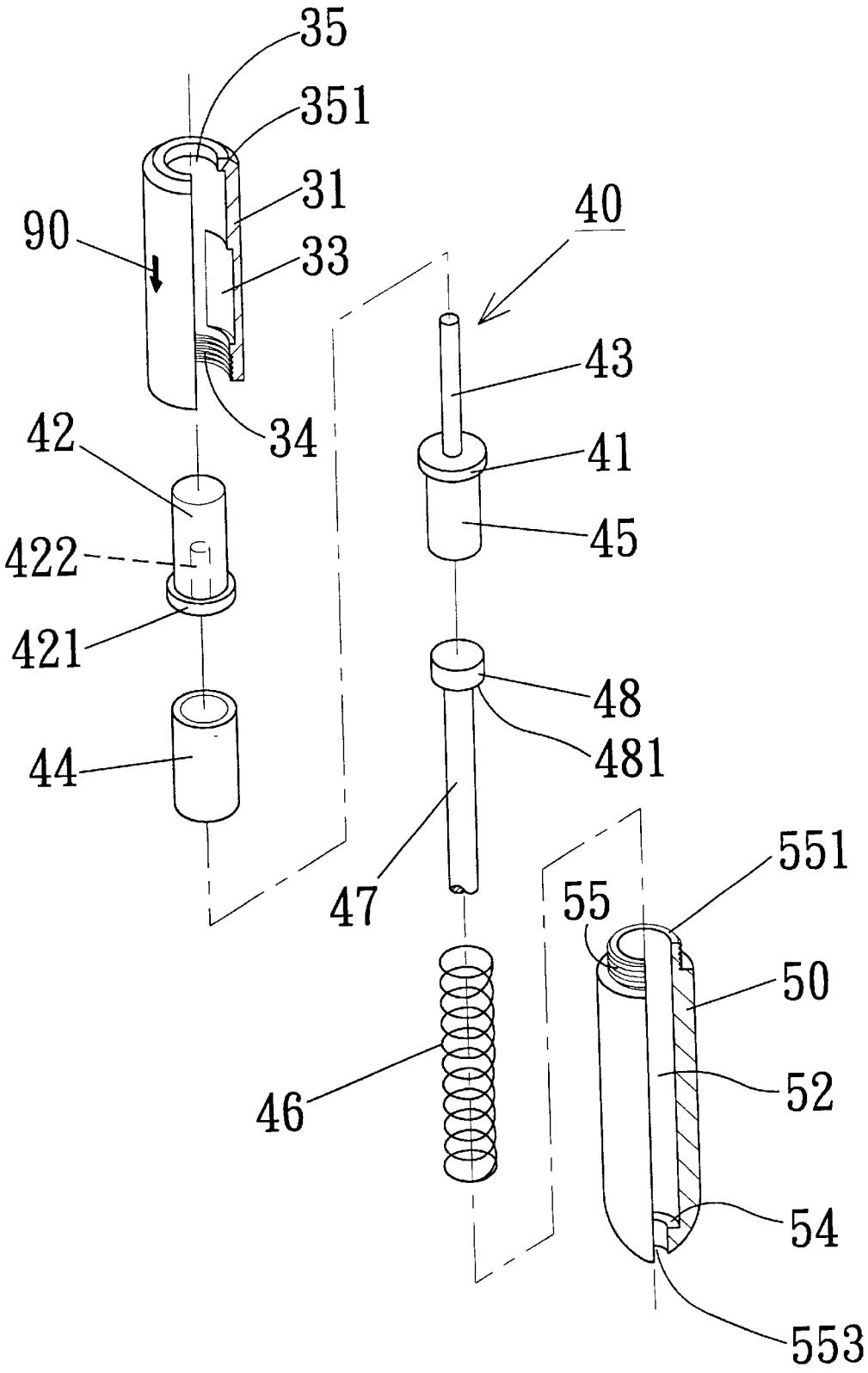
FIG. 2B is an exploded view of the telescopic device according to the another embodiment of the present invention.
Figure 3:
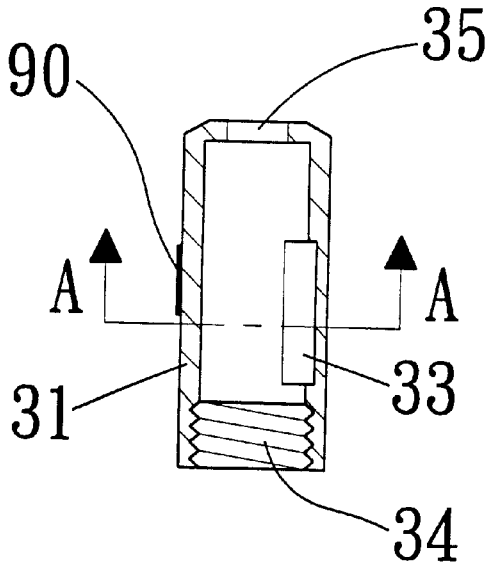
FIG. 3 shows a cross-sectional view of the hollow upper sleeve according the present invention in the longitudinal direction.
Figure 4:
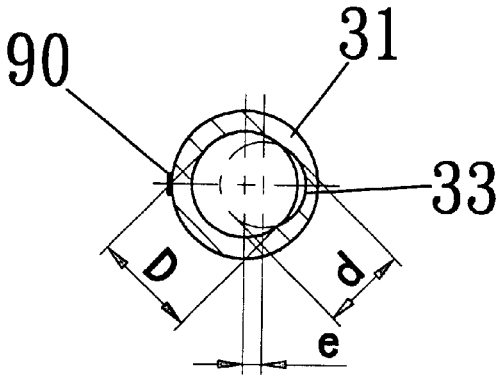
FIG.4 shows a cross-sectional view of the hollow upper sleeve along line A—A taken from FIG. 3 according to the present invention.
Figure 5:
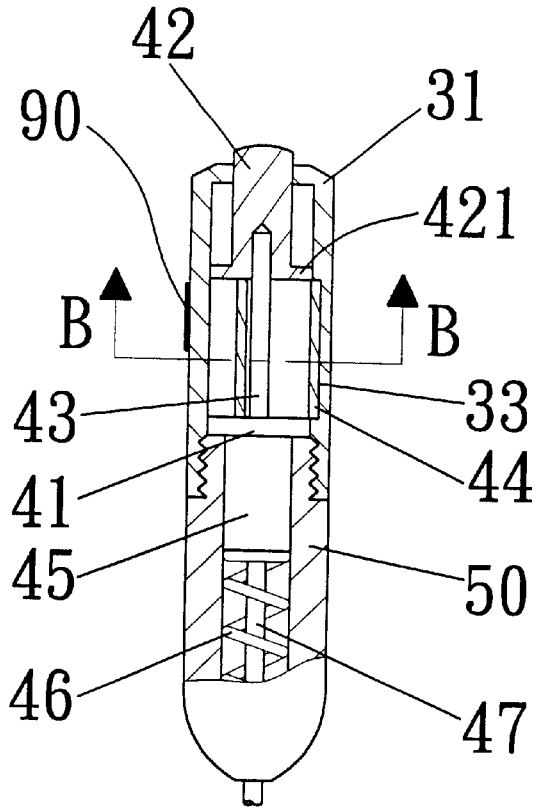
FIG. 5 shows a cross-sectional view of the thick rod according to the present invention in a protruded position.
Figure 6:
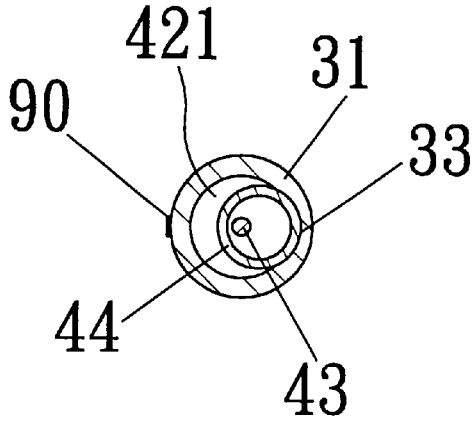
FIG.6 shows a cross-sectional view of the thick rod along line B—B taken from FIG. 5 according to the present invention.

Referring now to FIGS. 1, 2A and 2B, the telescopic device according to an embodiment of the present invention comprises a hollow upper sleeve 31, a push rod 42, a hollow cylinder 44, a guide mechanism 40, a spring 46 and a hollow lower sleeve 50. The hollow upper sleeve 31 is provided with internal threads 34 at the lower end thereof to match with external threads 55 disposed at a neck journal 551 at the upper end of the hollow lower sleeve 50. In addition, an arcuate recess 33 is provided at the inner wall of the upper hollow sleeve 31 and is located near the internal threads 34. Consequently, the inner diameter d of the hollow upper sleeve 31 at the location of the arcuate recess 33 is larger than the inner diameter D at remaining location thereof (see FIGS. 3 and 4). At least one symbol 90 is marked on the surface of the hollow upper sleeve 31.

The guide mechanism 40 includes a intermediate body 45 having a ring portion 41 at top end thereof, a thin rod 43 disposed on the ring portion 41 and a thick rod 47 disposed at the lower end of the intermediate body 45.

In combination, the upper hollow sleeve 31 is secured to the lower hollow sleeve 50 by the engagement of the internal threads 34 with the external threads 55. The thick rod 47 passing through the spring 46 is inserted into the hollow portion 52 of the lower hollow sleeve 50 through around opening 552 disposed at the neck journal 551. The thin rod 43 is passed through the hollow cylinder 44 and is disposed within the upper hollow sleeve 31. An elongated channel 422 is provided within the push rod 42 from the bottom ring 421 into which the thin rod 43 is inserted, the top portion of the push rod 42 protruding beyond the top portion of the upper hollow sleeve 31 through a through hole 35 disposed at the top portion thereof.

Figure 17:
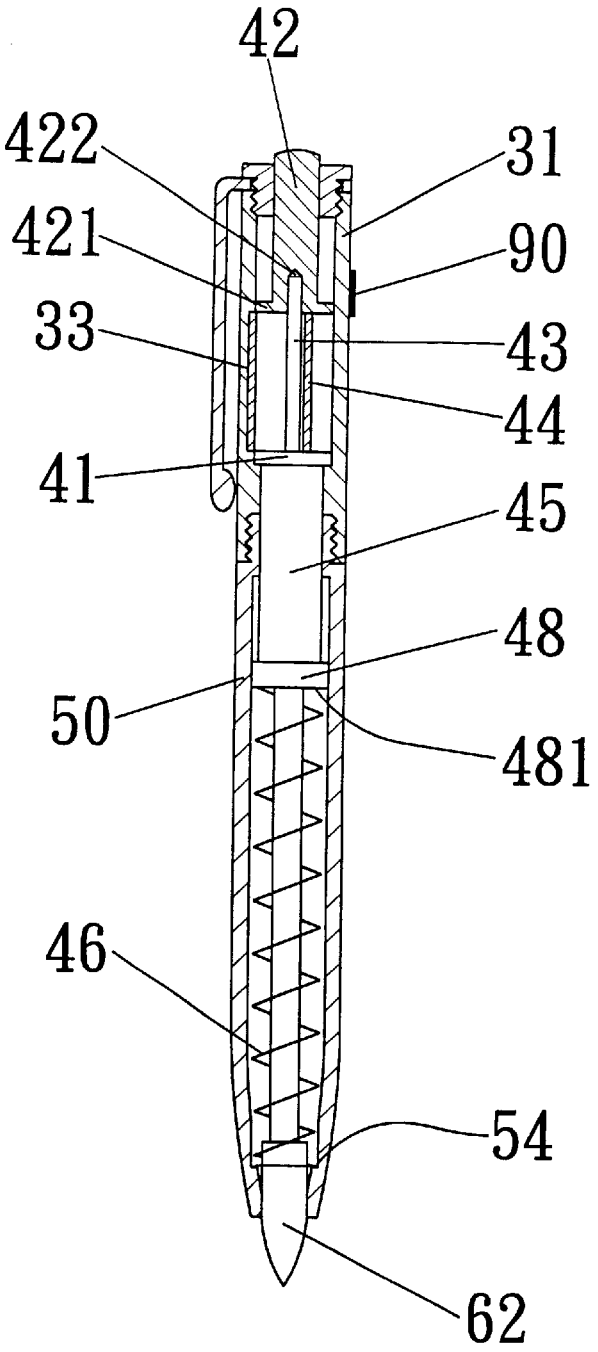
FIG. 17 shows a cross-sectional view of the thick rod replaced by a scratch awl according to the present invention.
Figure 18:
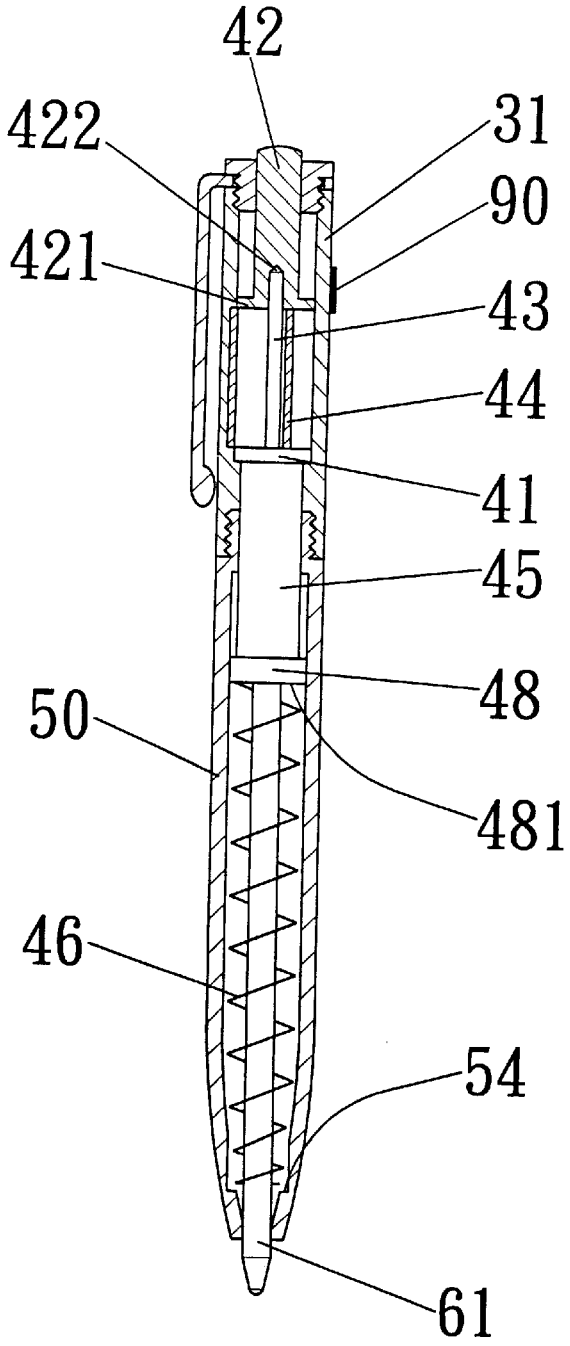
FIG. 18 shows a cross-sectional view of the thick rod replaced by a ball-pen core according to the present invention.
Figure 19:
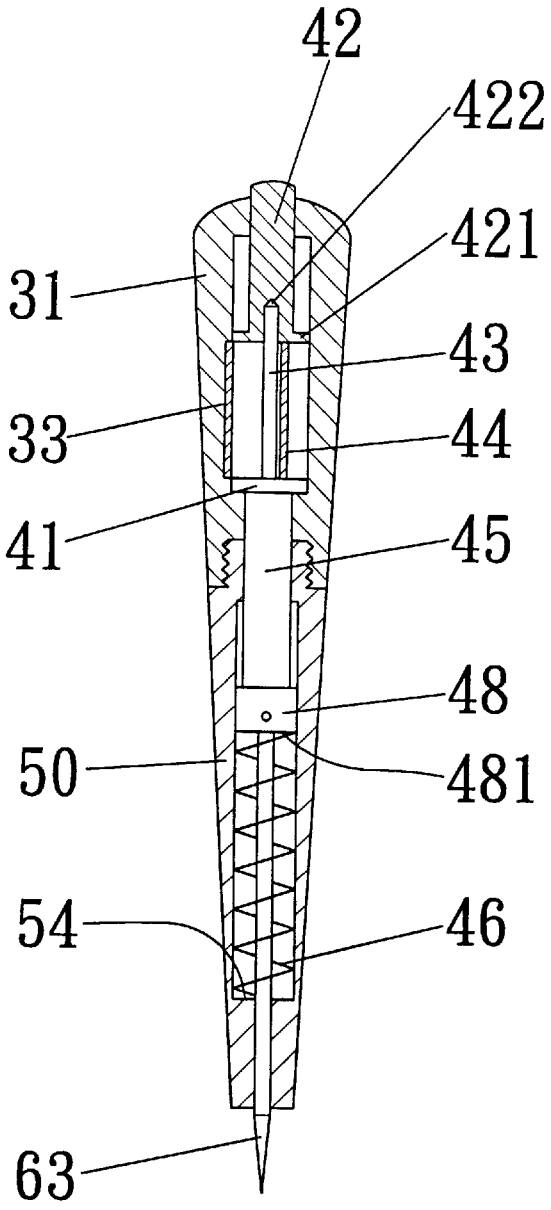
FIG. 19 shows a cross-sectional view of the thick rod replaced by a drill rod according to the present invention.
Figure 20:
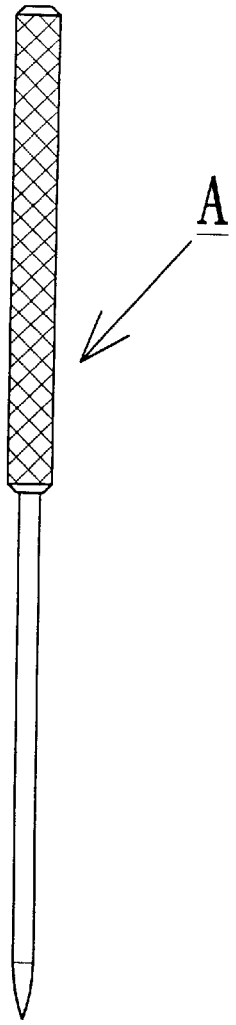
FIG. 20 (Prior Art)
FIG. 20 is a perspective view of a conventional drill bar.
Figure 21:
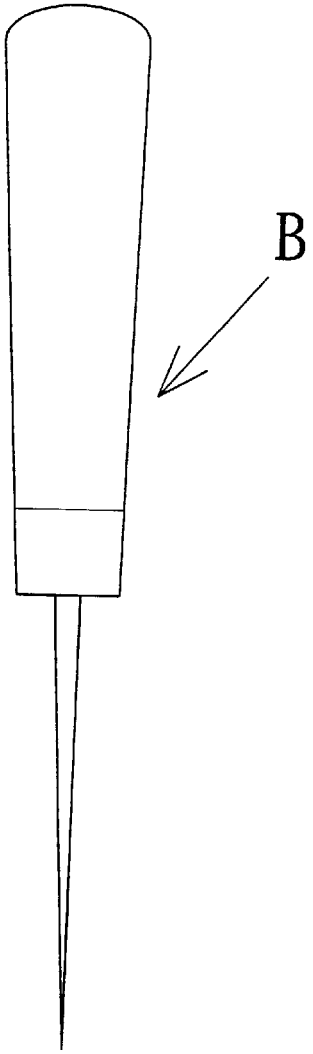
FIG. 21 (Prior Art)
FIG. 21 is a perspective view of a conventional scratch awl.
Figure 22:
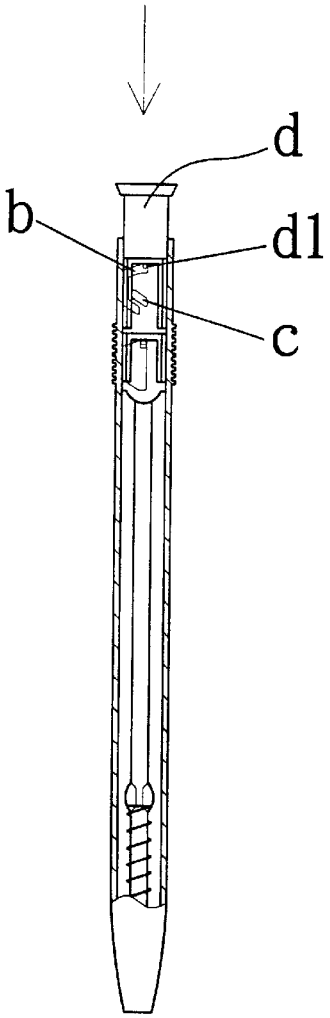
FIG. 22 (Prior Art)
FIG. 22 shows a cross-sectional view of a conventional telescopic ball-pen.
Figure 23:
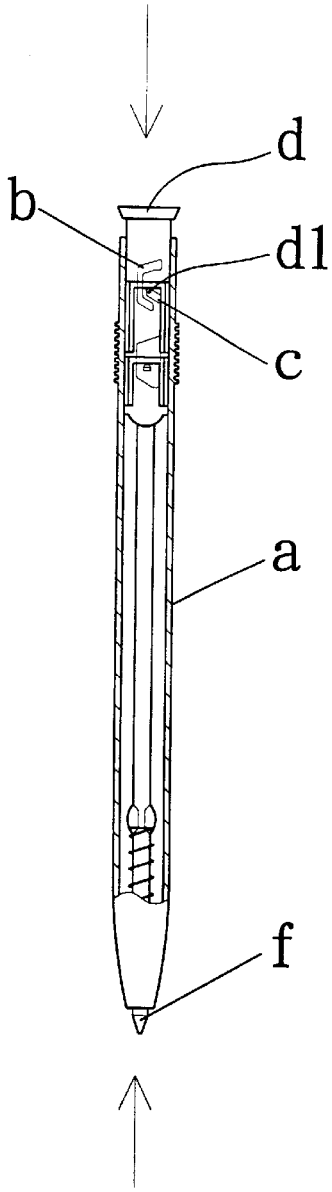
FIG. 23 (Prior Art)
FIG. 23 shows a cross-sectional view of the conventional telescopic ball-pen in FIG. 22 in a pressed form for use.
Figure 24:
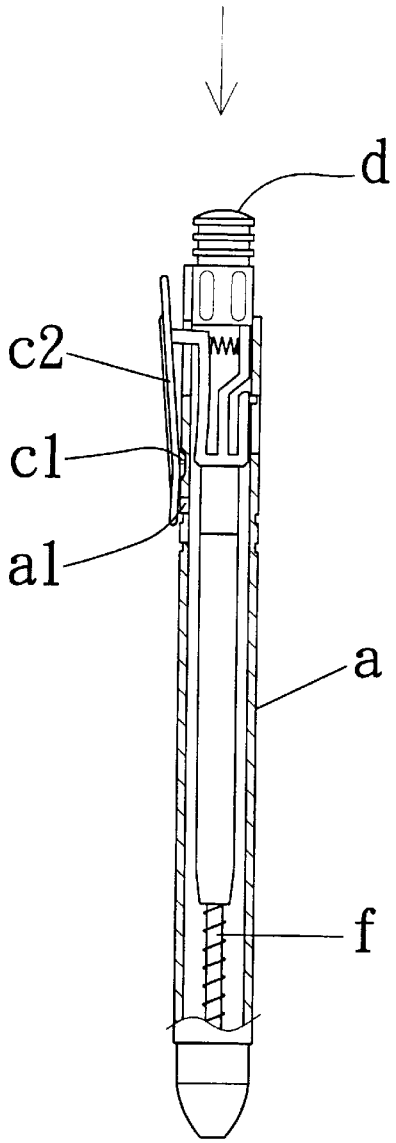
FIG. 24 (Prior Art)
FIG. 24 shows a cross-sectional view of another conventional telescopic ball-pen.
Figure 25:
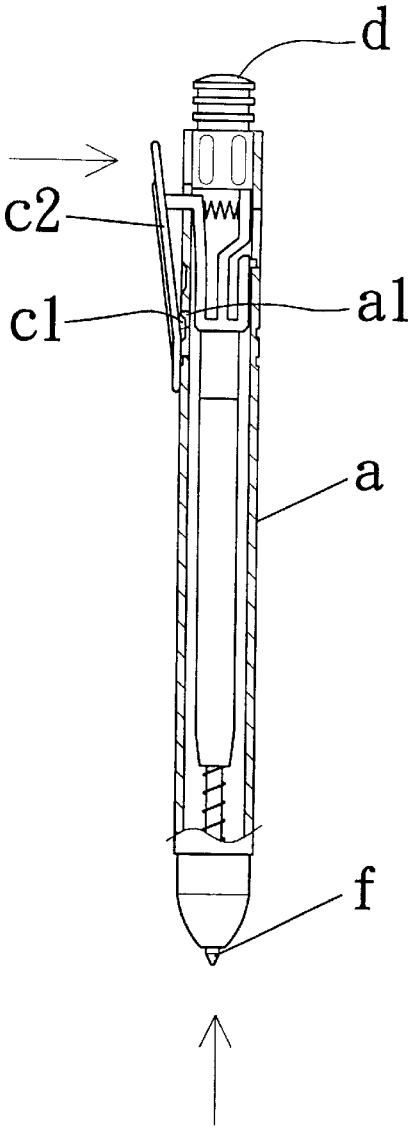
FIG. 25 (Prior Art)
FIG. 25 shows a cross-sectional view of the conventional telescopic ball-pen in FIG. 24 in a pressed form for use.
Figure 26:
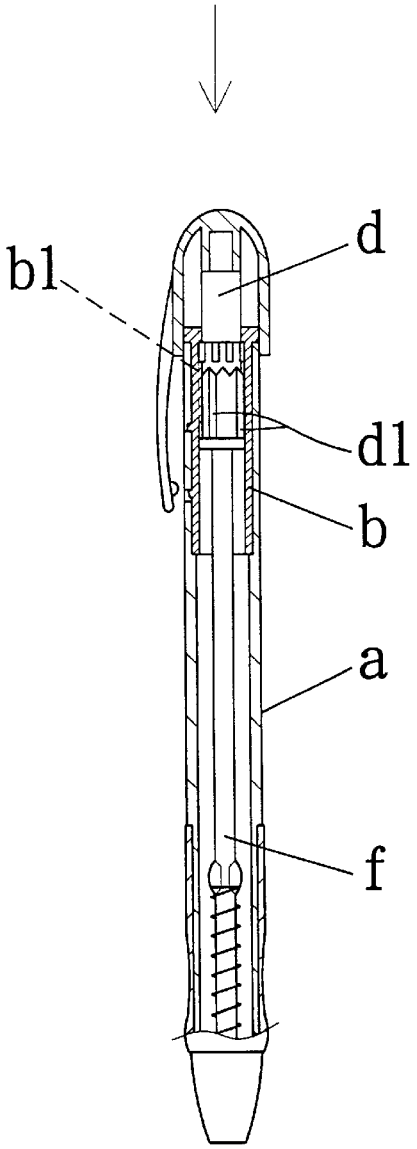
FIG. 26 (Prior Art)
FIG. 26 shows a cross-sectional view of a third conventional telescopic ball-pen.
Figure 27:
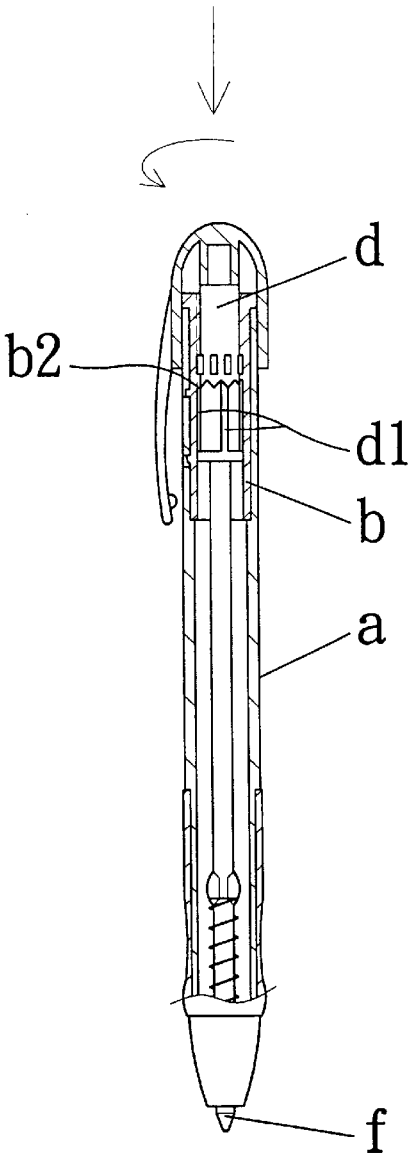
FIG. 27 (Prior Art)
FIG. 27 shows a cross-sectional view of the third conventional telescopic ball-pen in FIG. 26 in a pressed form for use.
Figure 28:
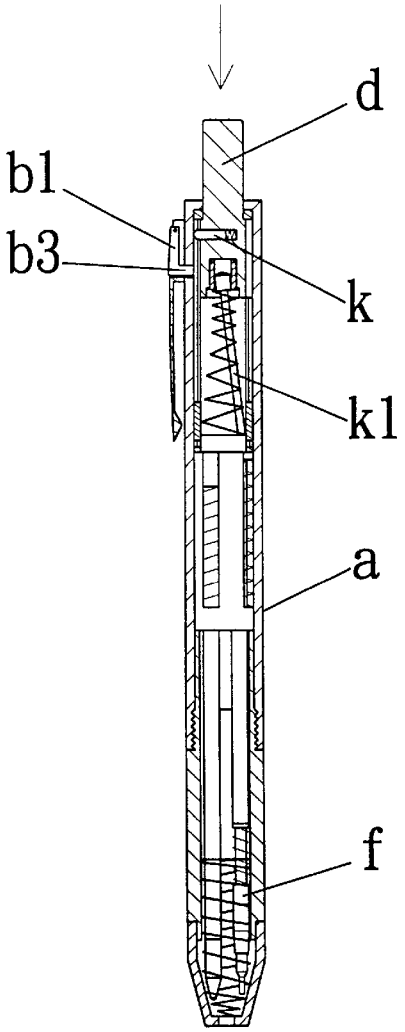
FIG. 28 (Prior Art)
FIG. 28 shows a cross-sectional view of a fourth conventional telescopic ball-pen.
Figure 29:
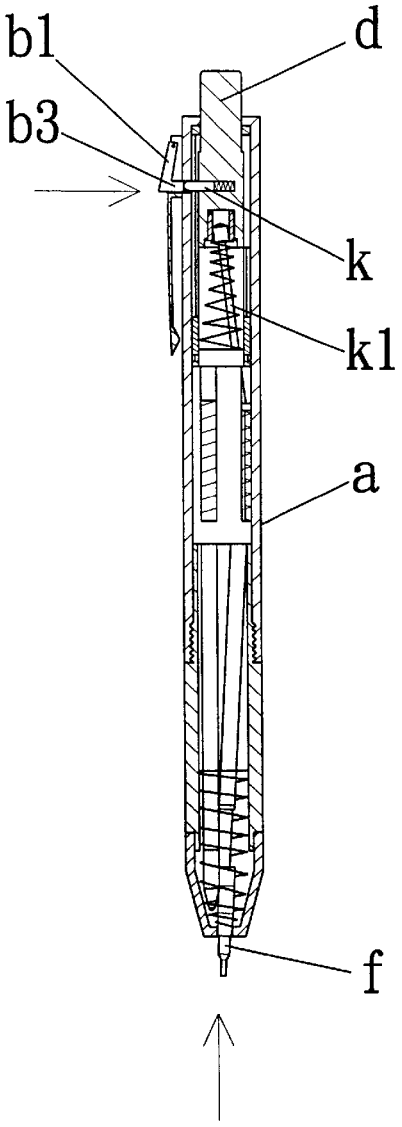
FIG. 29 (Prior Art)
FIG. 29 shows a cross-sectional view of the conventional telescopic ball-pen in FIG. 28 in a pressed form for use.

Referring to FIG. 2B, another embodiment of the telescopic device of the present invention is shown. In this second embodiment, the thick rod 47 is designed to be separated from the intermediate body 45 so that the spring 46 abuts against the ring surface 481 of a ring body 48 at the top of the thick rod 47. Therefore, the thick rod 47 can be replaced with a ball-pen core 61, a scratch awl 62 or a drill rod 63 depending on the user's demand (see FIGS. 17, 18 and 19).

Figure 7:
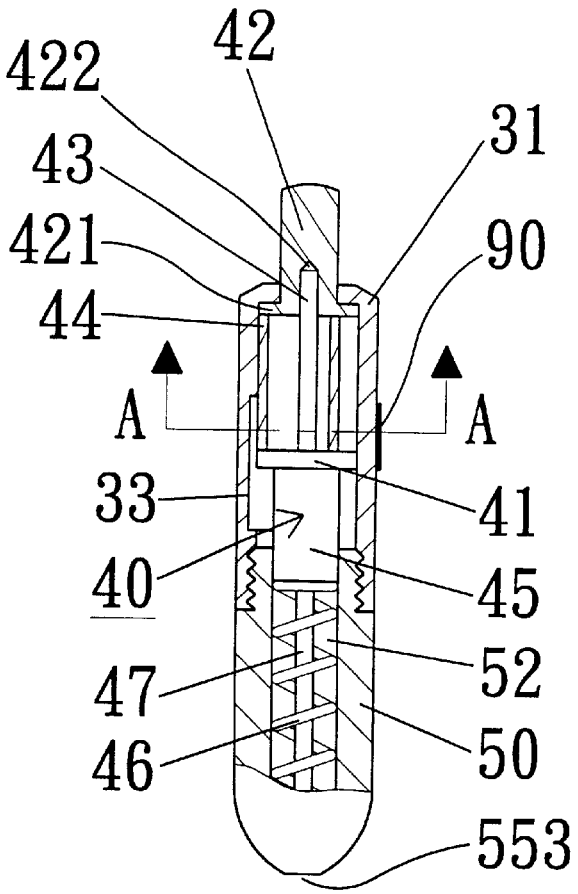
FIG. 7 shows a cross-sectional view of the thick rod according to the present invention in non-pressed condition.
Figure 8:
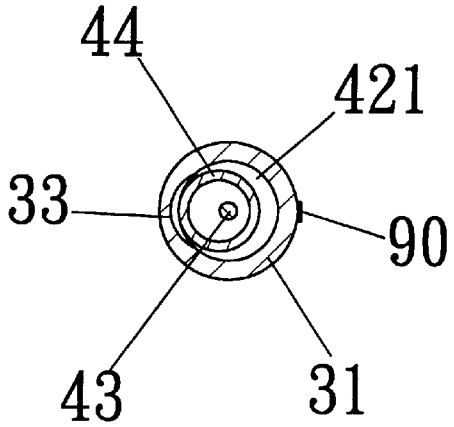
FIG. 8 shows a cross-sectional view of the thick rod along line A—A taken from FIG. 7 according to the present invention.

The operation of the telescopic device according to the present invention will now be described with reference to referring to FIGS. 7, 8. 9, 10, 11 and 12. In the extending operation, the telescopic device is inclined with the symbol 90 facing the palm of a user. The top portion of the push rod 42 is pressed. Consequently, the thin rod 43 is urged to move downwardly such that the spring 46 is compressed until the ring portion 41 comes into contact with the neck journal 551. At this point, the hollow cylinder 44 is moved to position within the arcuate recess 33, the top of the hollow cylinder 44 abutting against the edge 331 of the arcuate recess 33 so that the hollow cylinder 44 cannot upwardly move further. As a consequence, the thick rod 47 protrudes out of the lower hollow sleeve 50 via a hole 553 thereof and cannot be drawn back regardless of a large contacting force.

Figure 9:
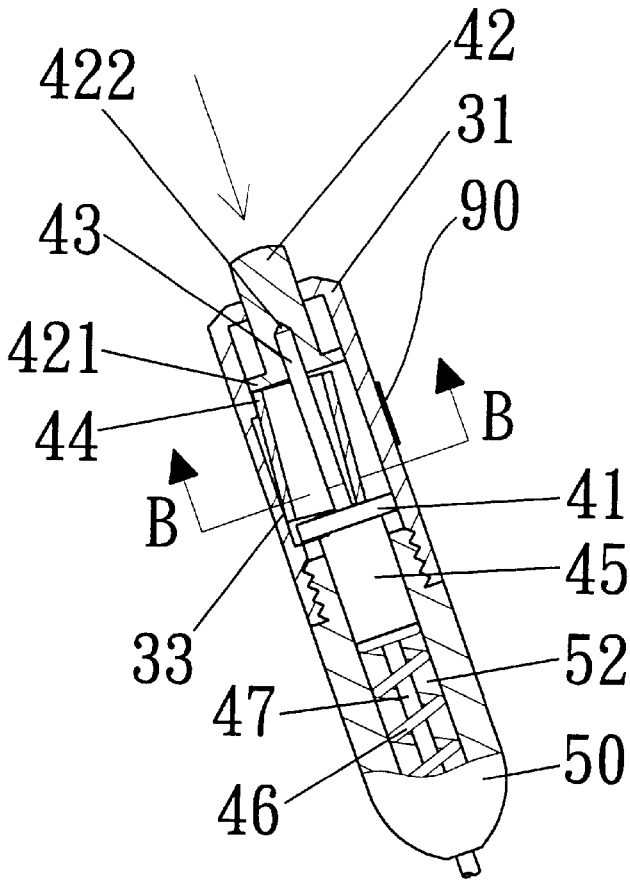
FIG. 9 shows a cross-sectional view of the thick rod according to the present invention in a protruded position.
Figure 10:
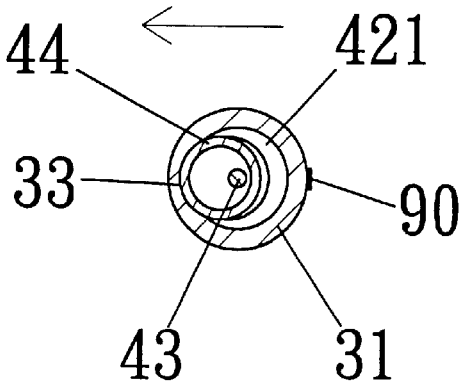
FIG. 10 shows a cross-sectional view of the thick rod along line B—B taken from FIG. 9 according to the present invention.
Figure 11:
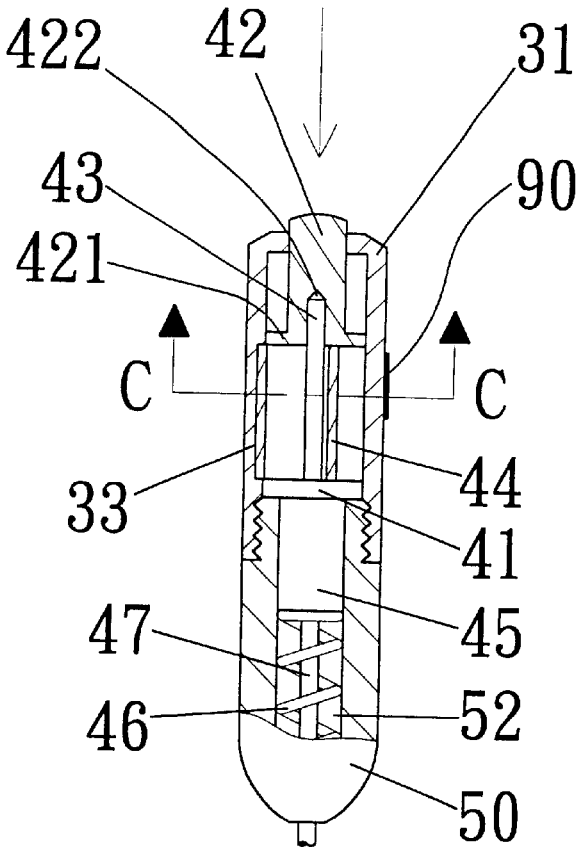
FIG. 11 shows a cross-sectional view of the thick rod according to the present invention in a protruded position.
Figure 12:
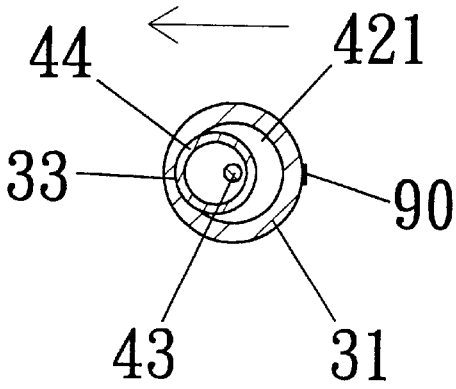
FIG. 12 shows a cross-sectional view of the thick rod along line C—C taken from FIG. 11 according to the present invention.
Figure 13:
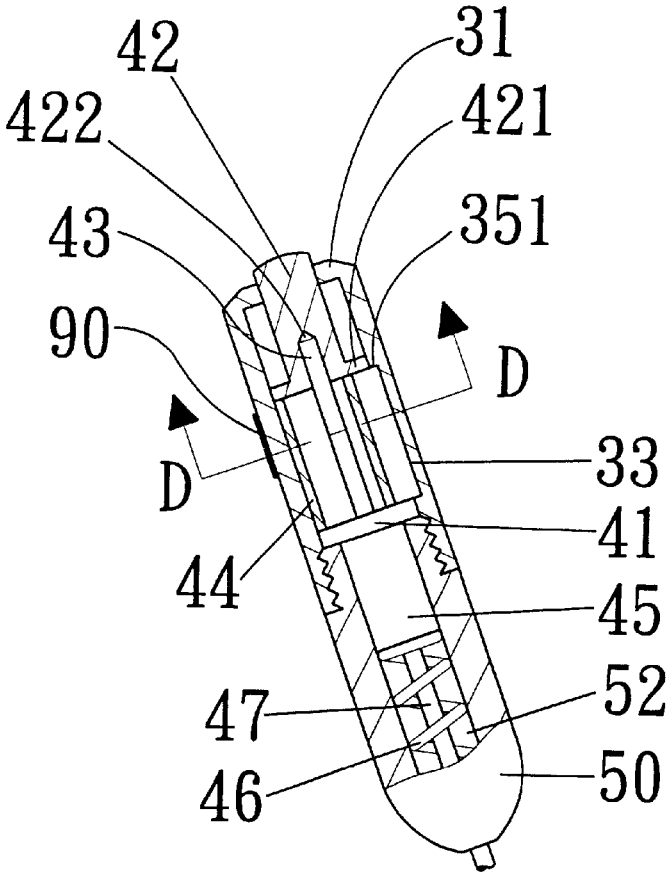
FIG. 13 shows a cross-sectional view of the thick rod according to the present invention in a retracted position.
Figure 14:
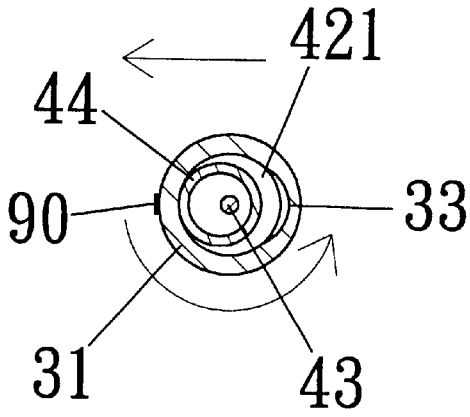
FIG. 14 shows a cross-sectional view of the thick rod along line D—D taken from FIG. 13 according to the present invention.
Figure 15:
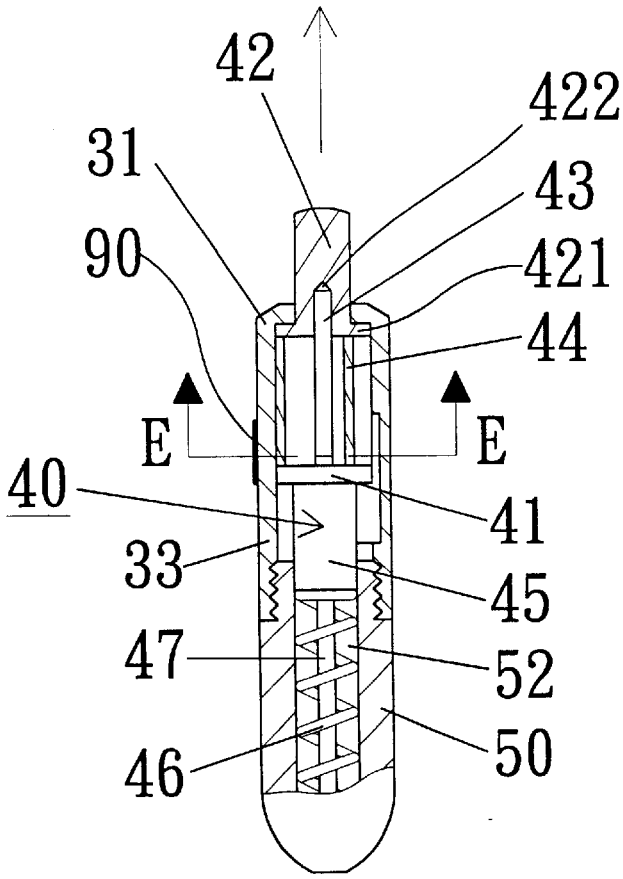
FIG. 15 shows a cross-sectional view of the thick rod according to the present invention in a fully retracted position.
Figure 16:
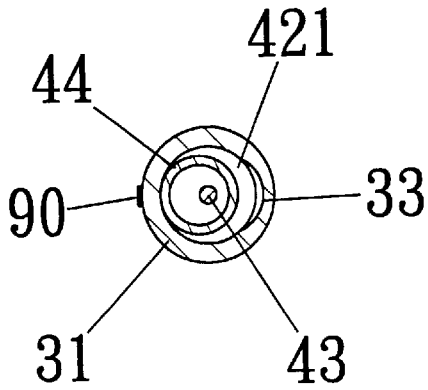
FIG. 16 shows a cross-sectional view of the thick rod along line E—E taken from FIG. 15 according to the present invention.

Referring to FIGS. 13 and 14, the thick rod 47 is retracted by rotating the telescopic device 90 degrees from the position as shown in FIG. 9, so that the symbol 90 is opposite the palm of the user, and then pressing slightly the push rod 42, so that the hollow cylinder 44 moves down from the actuate recess 33 while the restoring force of the spring 45 urges the guide mechanism 40 to move upwardly until the bottom ring 421 of the push rod 42 abuts against the top portion 351 of the upper hollow sleeve 31 (see FIGS. 15 and 16). Consequently, the thick rod 47 draws back inside the hollow lower sleeve 50.

Accordingly, the present invention provides a telescopic device which may be applied to a scratch awl, a drill bar, a ball-pen or a pencil which can achieve better positioning and can be easily retracted.

While there is shown and described herein certain specific structures embodying the present invention, it will be apparent to those skilled in the art that various modifications and rearrangements of the parts may be made without departing from the spirit and scope of the underlying inventive concept.

What is claimed is:

1. A telescopic device with a firm positioning effect, comprising:

a hollow upper sleeve having at least one arcuate recess at the inner wall thereof, and having a through hole at the top portion thereof and internal threads at the lower end thereof;

a hollow lower sleeve having external threads disposed at the upper end thereof to be threadedly connected to the internal threads of the hollow upper sleeve, and a hole formed in the lower end thereof;

a guide mechanism disposed within the hollow upper sleeve and hollow lower sleeve, and including an intermediate body having a ring portion at a top end thereof, a thin rod disposed on the ring portion and a thick rod-like element operatively associated with the lower end of the intermediate body wherein the thin rod protrudes outside of the through hole of the top portion of the hollow upper sleeve;

a spring positioned within the hollow lower sleeve and through which the thick rod-like element is passed;

a hollow cylinder for receiving the thin rod therethrough; and a push rod disposed within the through hole of the hollow cylinder and having an elongated channel extending from the bottom thereof and into which the thin rod is inserted, whereby, when the telescopic device is held with the arcuate recess facing downward and the push rod is pushed, the hollow cylinder slides into the arcuate recess and a lower end of the thick rod-like element extends out of the hole in the hollow lower sleeve.

2. A telescopic device as claimed in claim 1, wherein the thick rod-like element is selected from the group consisting of a scratch awl, a drill bar, a screw, a ball-pen and a pencil.

3. A telescopic device as claimed in claim 1 wherein the hollow cylinder is removable from the arcuate recess.

4. A telescopic device as claimed in claim 1 wherein the thick rod-like element is provided with a ring body disposed at the top thereof for providing resistance to the force of the spring.

5. A telescopic device as claimed in claim 1 further comprising at least one symbol located on the exterior surface of the hollow upper sleeve at a location diametrically opposite the location of the arcuate recess.

* * * * *